US011072504B2

(12) United States Patent
Tahara

(10) Patent No.: US 11,072,504 B2
(45) Date of Patent: Jul. 27, 2021

(54) SHEET FEEDING CASSETTE AND IMAGE FORMING APPARATUS INCLUDING THE SAME

(71) Applicant: KYOCERA Document Solutions Inc., Osaka (JP)

(72) Inventor: Mitsuhiro Tahara, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 15/967,806

(22) Filed: May 1, 2018

(65) Prior Publication Data

US 2018/0319611 A1 Nov. 8, 2018

(30) Foreign Application Priority Data

May 8, 2017 (JP) ..... JP2017-092213

(51) Int. Cl.
*B65H 1/04* (2006.01)
*B65H 1/26* (2006.01)
*B65H 1/08* (2006.01)

(52) U.S. Cl.
CPC ..... *B65H 1/266* (2013.01); *B65H 1/04* (2013.01); *B65H 1/08* (2013.01); *B65H 2402/5151* (2013.01); *B65H 2511/11* (2013.01); *B65H 2511/20* (2013.01)

(58) Field of Classification Search
CPC ..... B65H 1/00; B65H 2405/00; B65H 2405/1116; B65H 2405/112; B65H 2405/113; B65H 2405/114; B65H 2511/10; B65H 2511/12; B65H 2701/1131; B65H 1/04
See application file for complete search history.

(56) References Cited

U.S. PATENT DOCUMENTS 5,931,456 A * 8/1999 Laidlaw ..... B65H 1/04 271/171
7,527,259 B2 * 5/2009 Meetze, Jr. ..... B65H 1/04 271/171

(Continued)

FOREIGN PATENT DOCUMENTS

JP 2005-145706 6/2005
JP 2014-162562 * 9/2014

*Primary Examiner* — Thomas A Morrison
(74) *Attorney, Agent, or Firm* — Gerald E. Hespos; Michael J. Porco; Matthew T. Hespos

(57) ABSTRACT

A sheet feeding cassette includes a cassette body storing a sheet, and a cursor and a rack that position the sheet. The rack is disposed on a bottom of the cassette body and has rack-teeth. The cursor includes a cursor body having a contact face, a locking member having locking-teeth, and a handling member. The cursor body moves between a restricting position where the locking-teeth mesh with the rack-teeth to restrict cursor movement and an unrestricting position where the locking-teeth are separated above from the rack-teeth to allow cursor movement. The handling member is supported on the cursor body and is used to move the locking member. The locking member takes tilt-posture when moving between the restricting position and the unrestricting position. In the tilt-posture, the bottom face of the locking body inclines with respect to an imaginary plane including the rack teeth tips with the locking-teeth inclined.

5 Claims, 13 Drawing Sheets

(56) References Cited

U.S. PATENT DOCUMENTS

| | | | | |
|---|---|---|---|---|
| 8,246,045 | B2 * | 8/2012 | Kubo | B65H 1/266<br>271/145 |
| 8,387,971 | B2 * | 3/2013 | Sunohara | B65H 1/266<br>271/171 |
| 8,632,066 | B2 * | 1/2014 | Nakamura | B65H 1/266<br>271/171 |
| 2018/0273313 | A1 * | 9/2018 | Konishi | B65H 1/04 |

* cited by examiner

SHEET FEEDING CASSETTE AND IMAGE FORMING APPARATUS INCLUDING THE SAME

INCORPORATION BY REFERENCE

This application is based on Japanese Patent Application No. 2017-92213 filed on May 8, 2017 to the Japan Patent Office, the contents of which are incorporated by reference.

BACKGROUND

The present disclosure relates to a sheet feeding cassette and an image forming apparatus including the sheet feeding cassette.

An image forming apparatus including a sheet feeding cassette on which sheets are stacked is known as an apparatus such as a printer or a copying machine. A sheet feeding cassette is detachably set in a main housing of an image forming apparatus. A sheet feeding cassette includes a cassette body that stores a stack of sheets, a rack disposed on the bottom face of the cassette body, and a cursor provided in a manner movable along the rack, the rack including a plurality of rack teeth disposed at a predetermined interval to project upward.

The cursor includes a locking member (locking piece) having locking teeth that mesh with rack teeth of the rack. When the locking teeth of the locking member mesh with the rack teeth of the rack, the cursor is restricted from moving along the rack, and thereby determines the position of the sheet in the cassette body.

The locking member can move between a restricting position where the locking teeth mesh with the rack teeth to restrict the movement of the cursor and an unrestricting position where the locking teeth are positioned above and separated from the rack teeth to allow the movement of the cursor. By moving the locking member from the unrestricting position to the restricting position and positioning the locking member at the restricting position, the sheet is positioned in the cassette body by the cursor.

SUMMARY

A sheet feeding cassette according to one aspect of the present disclosure includes a cassette body, a cursor, and a rack. The cassette body stores a sheet that is to be fed in a predetermined sheet feeding direction. The cursor is provided in a manner movable in a moving direction intersecting the sheet feeding direction and positions the sheet in the cassette body. The rack is disposed along the moving direction on the bottom face of the cassette body and provided with a plurality of rack teeth disposed at a predetermined interval to project upward.

The cursor includes a cursor body and a locking member. The cursor body has a sheet-contact face that contacts an edge of the sheet. The locking member is provided in the cursor body to lock movement of the cursor.

The locking member includes a locking body having, on a bottom face, locking teeth projecting downward. The locking member is movable relative to the cursor body in the vertical direction between a restricting position where the locking teeth mesh with the rack teeth to restrict the movement of the cursor and an unrestricting position where the locking teeth are positioned above and separated from the rack teeth to allow the movement of the cursor.

The locking member takes a tilt-posture when moving between the restricting position and the unrestricting position, the tilt-posture being such that the bottom face of the locking body inclines with respect to an imaginary plane including distal tips of the rack teeth and the locking teeth incline with respect to the vertical direction to be displaced along the moving direction of the cursor.

An image forming apparatus according to another aspect of the present disclosure includes the sheet feeding cassette, a main housing in which the sheet feeding cassette is detachably set, and an image forming unit that is disposed in the main housing and forms an image on a sheet fed from the sheet feeding cassette.

DETAILED DESCRIPTION

A sheet feeding cassette and an image forming apparatus according to one embodiment of the present disclosure will now be described based on the drawings. The directional relationship will be described using XYZ orthogonal coordinate axes in the following description. X-direction represents the right-and-left direction (+X is the rightward direction and −X is the leftward direction). Y-direction represents the front-and-rear direction (+Y is the forward direction and −Y is the rearward direction). Z-direction represents the vertical direction (+Z is the upward direction and −Z is the downward direction). In the following description, the term "sheet" means a sheet material, such as a copying paper, a coated paper, an OHP sheet, a cardboard, a postcard, a tracing paper, a sheet material subjected to image forming processing, and a sheet material subjected to any processing other than image forming processing.

[Overall Configuration of Image Forming Apparatus]

Figure 1:
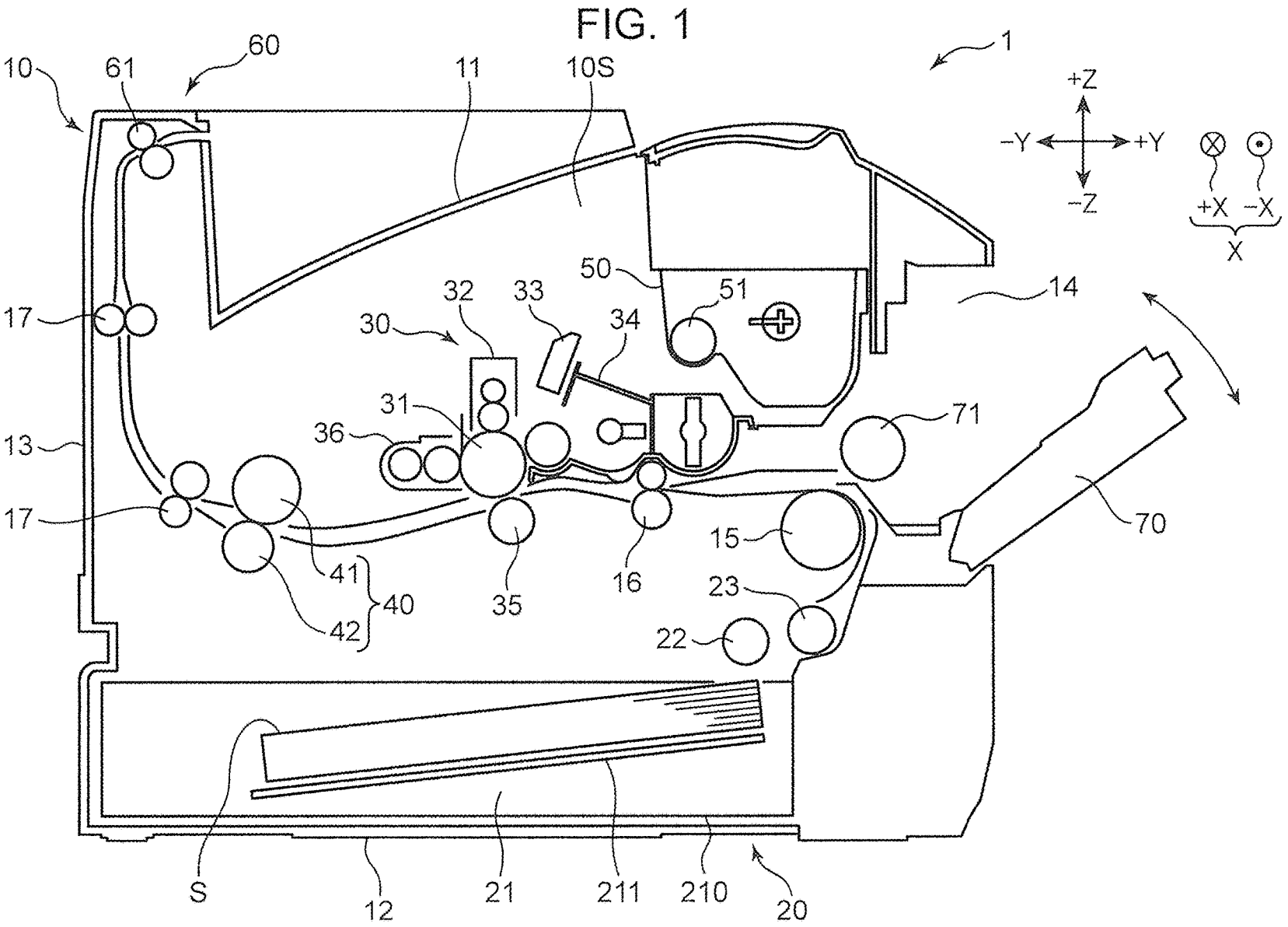
FIG. 1 schematically illustrates an internal configuration of an image forming apparatus including a sheet feeding cassette according to one embodiment of the present disclosure.

FIG. 1 schematically illustrates an internal configuration of an image forming apparatus 1 according to one embodiment of the present disclosure. The image forming apparatus 1 is of an electrophotographic apparatus that forms an image on a sheet S. Although a black-and-white printer is exemplarily described as the image forming apparatus 1, the image forming apparatus 1 may be a copier, a fax machine, or a copying machine having functions of a copier and a fax machine. The image forming apparatus 1 may be configured to form color images.

The image forming apparatus 1 includes a main housing 10 having a housing structure and an approximately rectangular shape, a sheet feeder 20 housed in an internal space 10S of the main housing 10, an image forming unit 30, a fixing unit 40, a toner container 50, and a sheet discharging unit 60.

The main housing 10 has a top wall 11 that demarcates the top face of the main housing 10, a bottom wall 12 that demarcates the bottom face of the main housing 10, and a rear wall 13 that is in −Y side (rear side) to vertically extend between the top wall 11 and the bottom wall 12. A manual-feed tray 70 is provided in +Y side (front side) of the main housing 10. The manual-feed tray 70 can pivot upward and downward. As illustrated in FIG. 1, an open-section 14 provided in +Y side of the main housing 10 opens to the outer side by pivoting the manual-feed tray 70 downward. The open-section 14 communicates with the internal space 10S in the main housing 10. A user can access the components housed in the internal space 10S in the main housing 10 through the open-section 14. The open-section 14 is closed by pivoting the manual-feed tray 70 upward. In this state, unnecessary access to the internal space 10S by a user is prevented. The top wall 11 of the main housing 10 serves as a sheet-receiving tray on which the sheet S discharged from the internal space 10S of the main housing 10 is stacked.

The sheet feeder 20 includes a sheet feeding cassette 21 that stores the sheet S on which image forming processing is performed, a pickup roller 22, and a feed roller 23. The sheet feeding cassette 21 includes a cassette body 210 that stores a stack of sheets S, and a lift plate 211 that lifts up the stack of sheets S in the cassette body 210. The cassette body 210 has an approximately rectangular shape with an opening on the top face. Details on the sheet feeding cassette 21 will be described later.

The pickup roller 22 is disposed on the front edge of the sheet S pushed up by the lift plate 211 in the cassette body 210 of the sheet feeding cassette 21. The pickup roller 22 rotates to pull out the sheet S from the cassette body 210 of the sheet feeding cassette 21.

The feed roller 23 is disposed in the downstream of the pickup roller 22 to send the sheet S further in the downstream. Further, a user may place the sheet S on the manual-feed tray 70. The sheet S placed on the manual-feed tray 70 is pulled into the main housing 10 by a feed roller 71 provided near the manual-feed tray 70.

A convey roller 15 is provided in the downstream of the feed rollers 23 and 71. The convey roller 15 conveys the sheet S sent by the feed rollers 23 and 71 to a resist-roller-pair 16. The resist-roller-pair 16 straightens the sheet S that has been conveyed diagonally. The position of an image to be formed on the sheet S is thus adjusted. The resist-roller-pair 16 sends the sheet S to the image forming unit 30 at a suitable timing for the image forming unit 30 to perform image forming processing.

The image forming unit 30 performs image forming processing, namely, forms a toner image on the sheet S sent by the resist-roller-pair 16. The image forming unit 30 includes a photoreceptor drum 31 and components disposed around the photoreceptor drum 31. The components are a charging unit 32, an exposing unit 33, a developing unit 34, a transfer roller 35, and a cleaning unit 36.

The photoreceptor drum 31 has a shape of a cylinder and is rotatable about a rotational axis extending in the X-direction (right-and-left direction). An electrostatic latent image is formed on the outer circumferential surface of the photoreceptor drum 31, and photoreceptor drum 31 carries a toner image corresponding to the electrostatic latent image. The charging unit 32 uniformly charges the surface of the photoreceptor drum 31 and includes a charging roller that is in contact with the photoreceptor drum 31.

The cleaning unit 36 includes a cleaning blade (not shown). The cleaning unit 36 cleans off the toner adhering to the circumferential surface of the photoreceptor drum 31 after transfer of the toner image and conveys the cleaned off toner to a collecting unit (not shown). The exposing unit 33 includes a laser light source and an optical device such as a mirror and a lens. The exposing unit 33 emits a light modulated based on image data provided by an external device, such as a personal computer, to the outer circumferential surface of the photoreceptor drum 31 to form an electrostatic latent image. The developing unit 34 supplies toner to the outer circumferential surface of the photoreceptor drum 31 to develop the electrostatic latent image on the photoreceptor drum 31 and thereby forming a toner image.

The transfer roller 35 transfers the toner image formed on the outer circumferential surface of the photoreceptor drum 31 onto the sheet S. The transfer roller 35 is in contact with the outer circumferential surface of the photoreceptor drum 31 and forms a transfer nip. The transfer roller 35 is given a transfer bias having a polarity that is opposite the polarity of the toner.

A fixing unit 40 performs fix processing to fix the transferred toner image (image) to the sheet S. The fixing unit 40 includes a fixing roller 41 having inside a heating source, and a pressing roller 42 that is pressed against the fixing roller 41 to form a fixing nip between the pressing roller 42 and the fixing roller 41. When the sheet S with a toner image transferred thereon passes through the fixing nip, the toner image is fixed onto the sheet S by heating by the fixing roller 41 and pressuring by the pressing roller 42.

A toner container 50 stores supply toner that is supplied to the developing unit 34. The rotating member 51 is rotated to supply the supply toner stored in the toner container 50 to the inside of the developing unit 34.

A plurality of convey-roller-pairs 17 is provided in the downstream of the fixing unit 40. The sheet S that is treated by image forming processing with the image forming unit 30 and then by fix processing with the fixing unit 40 is conveyed to the sheet discharging unit 60 by a plurality of the convey-roller-pairs 17. The sheet discharging unit 60 includes a discharge-roller-pair 61. The sheet S conveyed by the convey-roller-pair 17 is discharged by the discharge-roller-pair 61 to the top wall 11 serving as the sheet-receiving tray. The sheet S discharged out of the main housing 10 by the discharge-roller-pair 61 is stacked on the top wall 11.

[Configuration of Sheet Feeding Cassette]

<Overall Configuration of Sheet Feeding Cassette>

Figure 2:
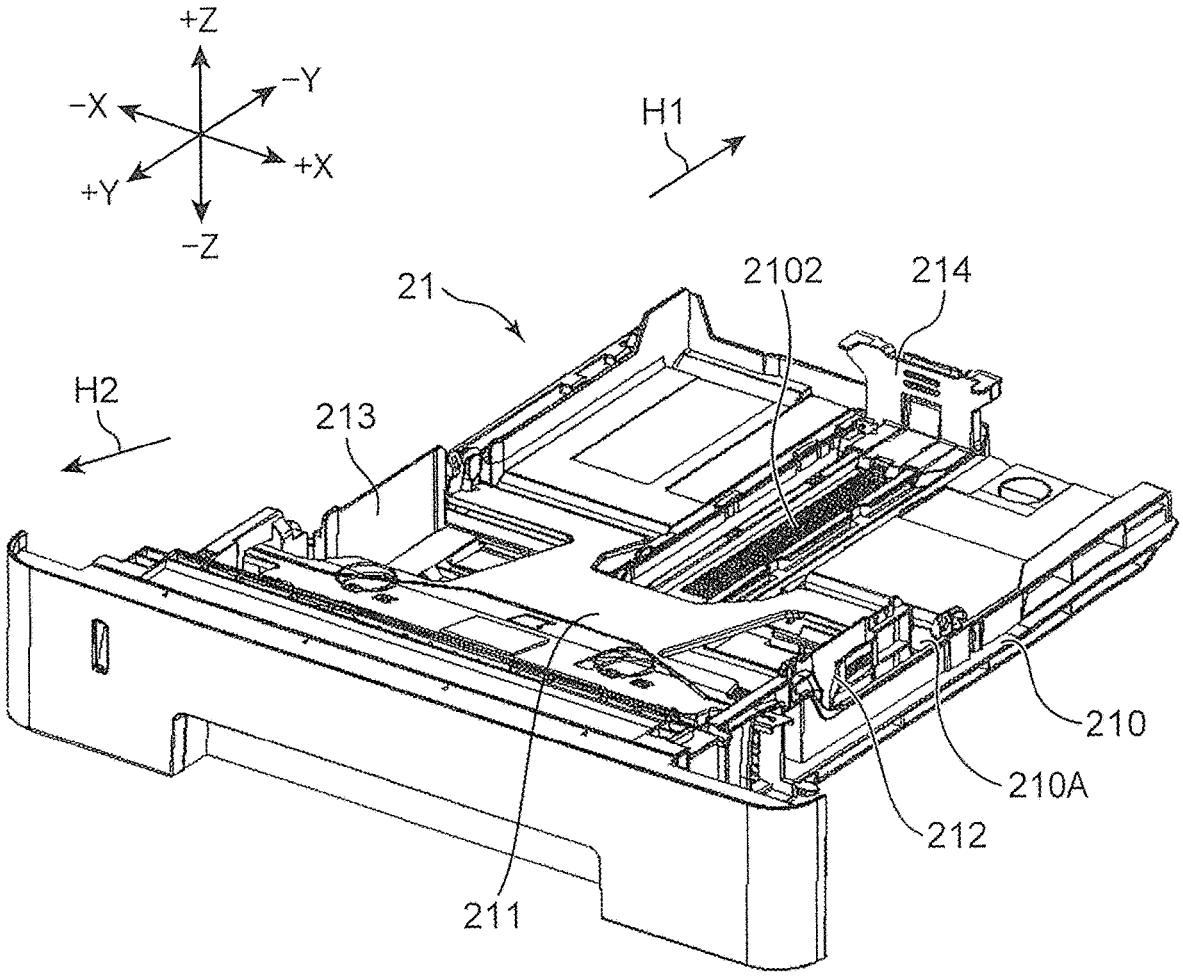
FIG. 2 is a perspective view of the sheet feeding cassette.
Figure 3A:
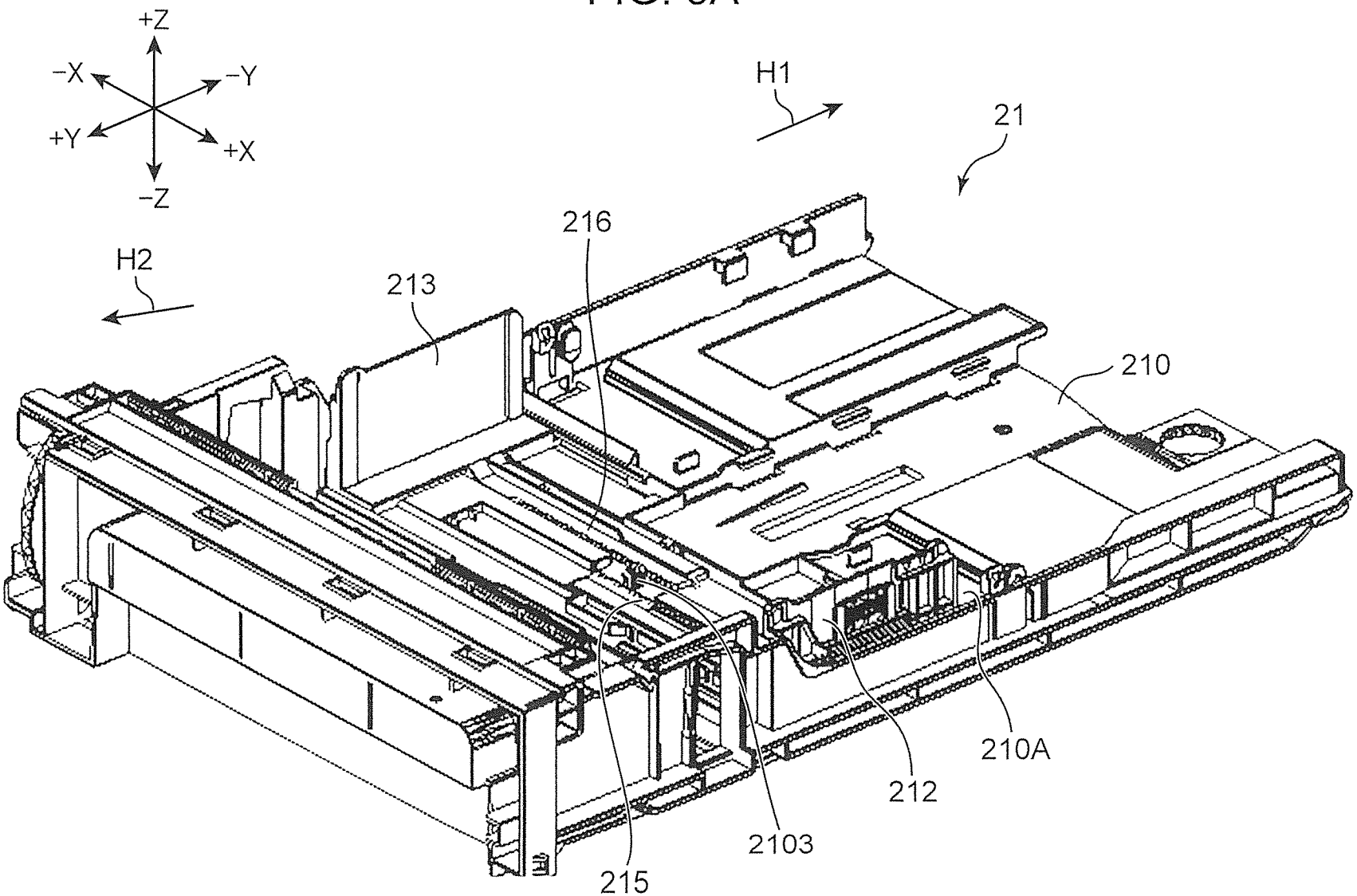
FIG. 3A is a perspective view of the sheet feeding cassette where a lift plate is removed.
Figure 3B:
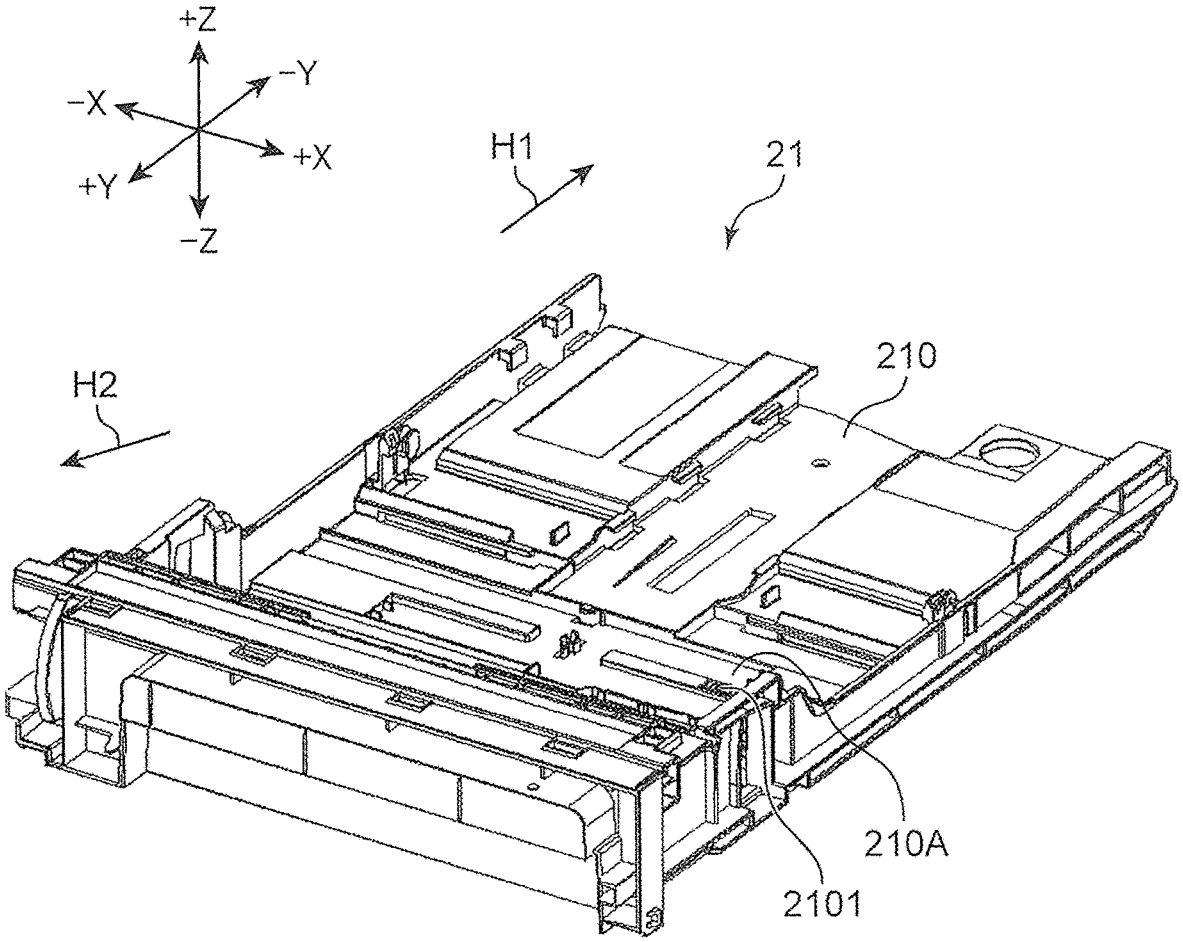
FIG. 3B is a perspective view of the sheet feeding cassette where the lift plate, a first cursor, and a second cursor are removed.

The sheet feeding cassette 21 will now be described in detail with reference to FIGS. 2, 3A, and 3B together with FIG. 1. FIG. 2 is a perspective view of the sheet feeding cassette 21. FIG. 3A is a perspective view of the sheet feeding cassette 21 where the lift plate 211 is removed. FIG. 3B is a perspective view of the sheet feeding cassette 21 where the lift plate 211, a first cursor 212, and a second cursor 213 are removed.

As described above, the sheet feeding cassette 21 includes the cassette body 210 and the lift plate 211. The sheet feeding cassette 21 is detachably set in the main housing 10. The sheet feeding cassette 21 is advanced along set direction H1 to be set in the main housing 10. The set direction H1 of the sheet feeding cassette 21 is the direction from +Y side (front side) to −Y side (rear side). The sheet S lifted up by the lift plate 211 in the sheet feeding cassette 21 is fed in a sheet feeding direction H2, where the sheet feeding direction H2 is the direction along Y-direction (front-and-rear direction) and approximately opposite the set direction H1.

The sheet feeding cassette 21 includes, in addition to the cassette body 210 and the lift plate 211, a stopper rack 2101 (see FIG. 3B), and a rear end cursor stopper rack 2102 (see FIG. 2).

The stopper rack 2101 is disposed on a bottom face 210A of the cassette body 210 to extend in the X-direction (right-and-left direction) intersecting the sheet feeding direction H2. The stopper rack 2101 is for stopping the first cursor 212 which will be described later. The stopper rack 2101 has a plurality of rack teeth 2101A (which will be described later with reference to FIG. 7A) provided at a predetermined interval along X-direction to project upward (to +Z side). The rear end cursor stopper rack 2102 is disposed on the bottom face 210A of the cassette body 210 to extend in Y-direction parallel to the sheet feeding direction H2. The rear end cursor stopper rack 2102 is for stopping a rear end cursor 214 which will be described later.

As illustrated in FIGS. 2 and 3A, the sheet feeding cassette 21 further includes the first cursor 212, the second cursor 213, the rear end cursor 214, a first positioning rack 215, a second positioning rack 216, and a pinion gear 2103.

The first cursor 212 is provided in a manner allowed to move along the stopper rack 2101, that is, the X-direction intersecting the sheet feeding direction H2. The first cursor 212 comes in contact with the +X side (right) edge of the sheet S in the cassette body 210. The second cursor 213 is disposed in the −X side (left side) to oppose the first cursor 212. The second cursor 213 is movable in the X-direction and comes in contact with the −X side edge of the sheet S in the cassette body 210. The first cursor 212 and the second cursor 213 determine the X-directional position of the sheet S in the cassette body 210.

The first positioning rack 215 extends in the −X side from the first cursor 212 and is used for moving the first cursor 212. The second positioning rack 216 extends in the +X side from the second cursor 213 and is used for moving the second cursor 213. The pinion gear 2103 is rotatably disposed between the first cursor 212 and the second cursor 213 and on the bottom face 210A of the cassette body 210. The pinion gear 2103 is engaged with the first positioning rack 215 and the second positioning rack 216. In this manner, each of the first cursor 212 and the second cursor 213 moves in the X-direction in conjunction with the rotation of the pinion gear 2103. That is, the first cursor 212 moves in the X-direction in conjunction with the first positioning rack 215 moving in the X-direction by the rotation of the pinion gear 2103. In conjunction with the second positioning rack 216 moving in the X-direction by the rotation of the pinion gear 2103, the second cursor 213 moves in the direction opposite the moving direction of the first cursor 212.

The rear end cursor 214 is provided in a manner allowed to move in the Y-direction along the rear end cursor stopper rack 2102. The rear end cursor 214 comes in contact with the rear end, with respect to the sheet feeding direction H2, of the sheet S in the cassette body 210. The rear end cursor 214 determines the Y-directional position of the sheet S in the cassette body 210.

<Details on First Cursor>

Figure 4:
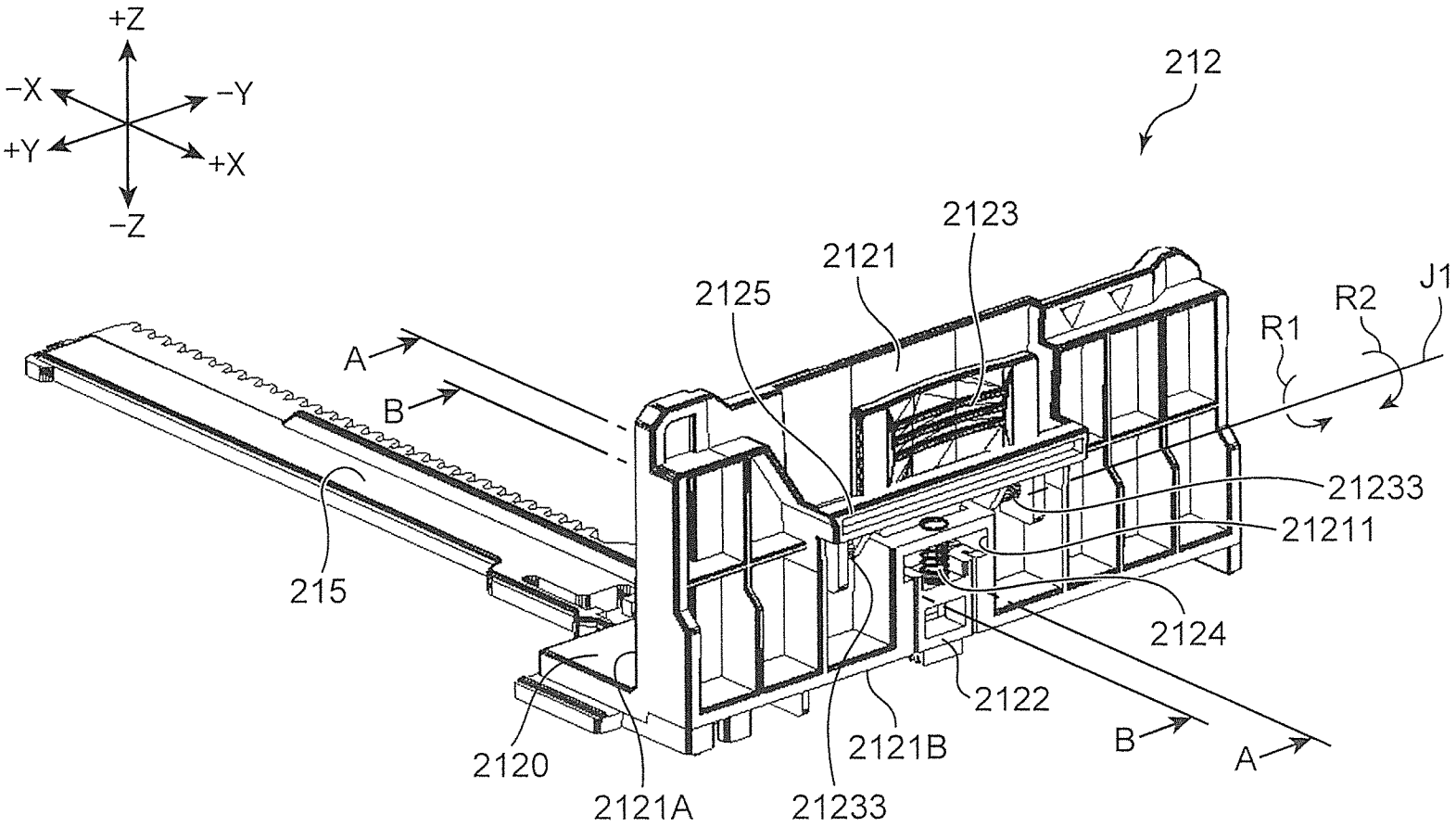
FIG. 4 is a perspective view of the first cursor of the sheet feeding cassette.
Figure 5:
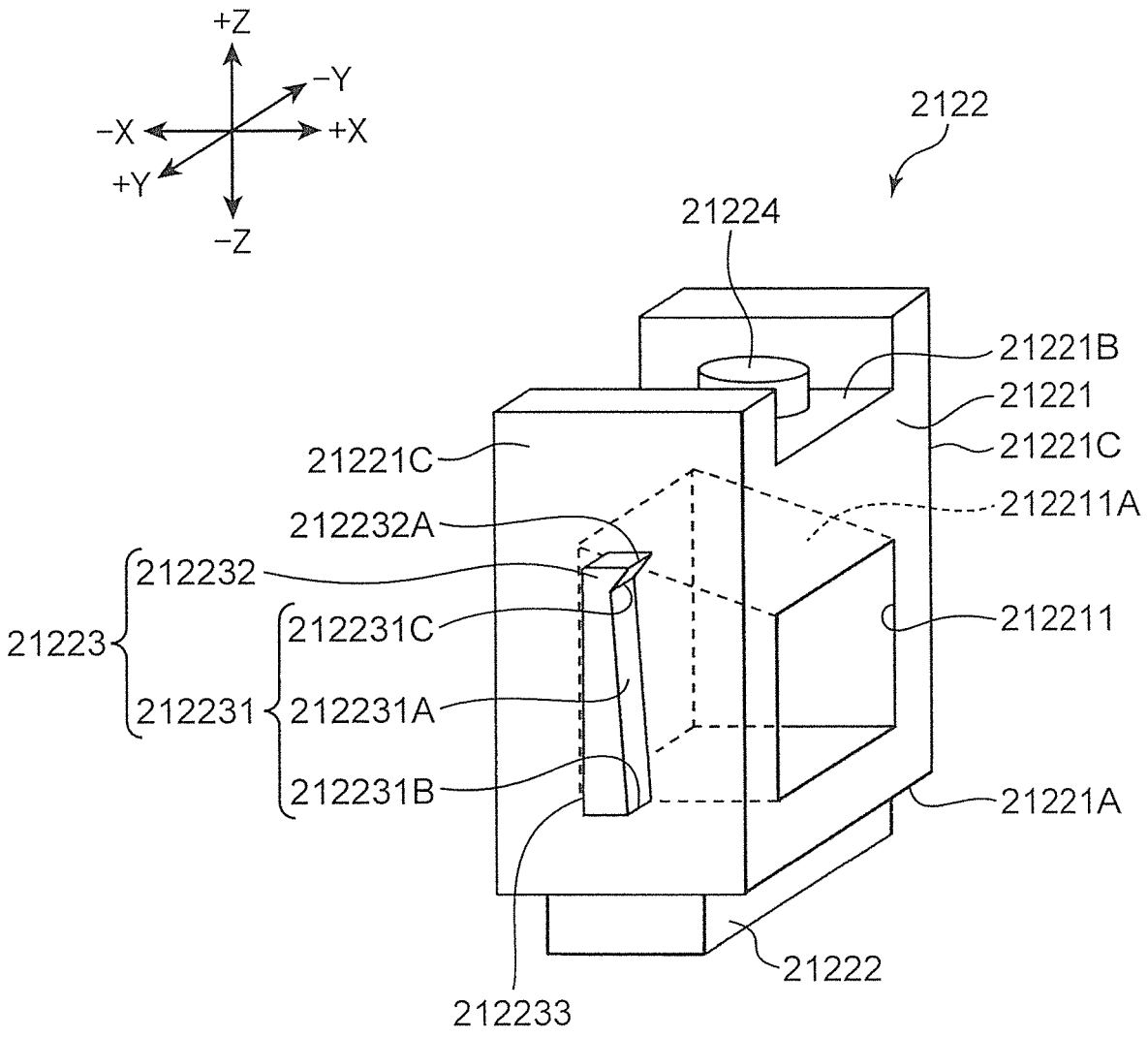
FIG. 5 is a perspective view of a locking member of the first cursor.
Figure 6:
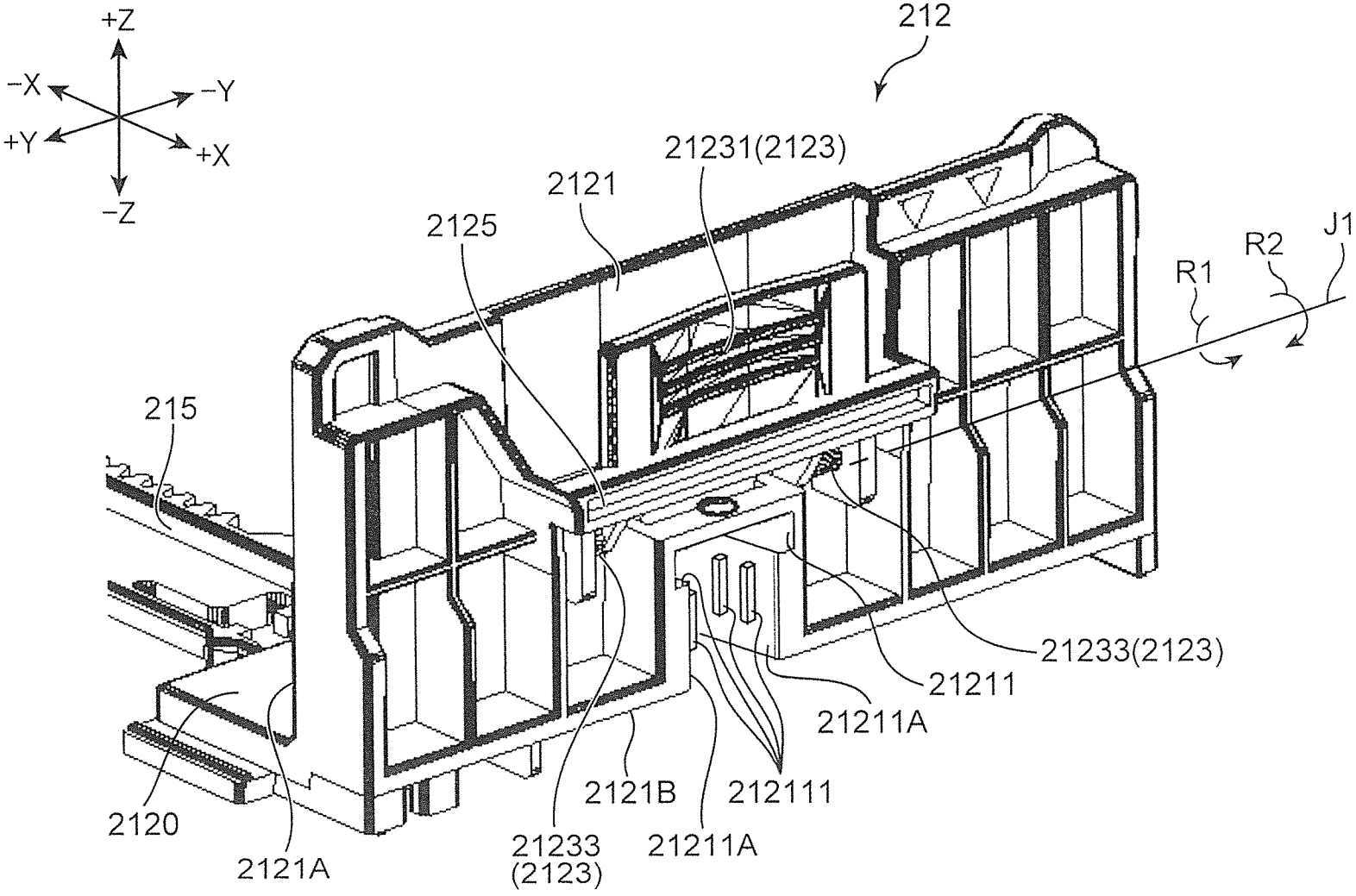
FIG. 6 is an enlarged perspective view illustrating an essential portion of the cursor body of the first cursor.
Figure 7A:
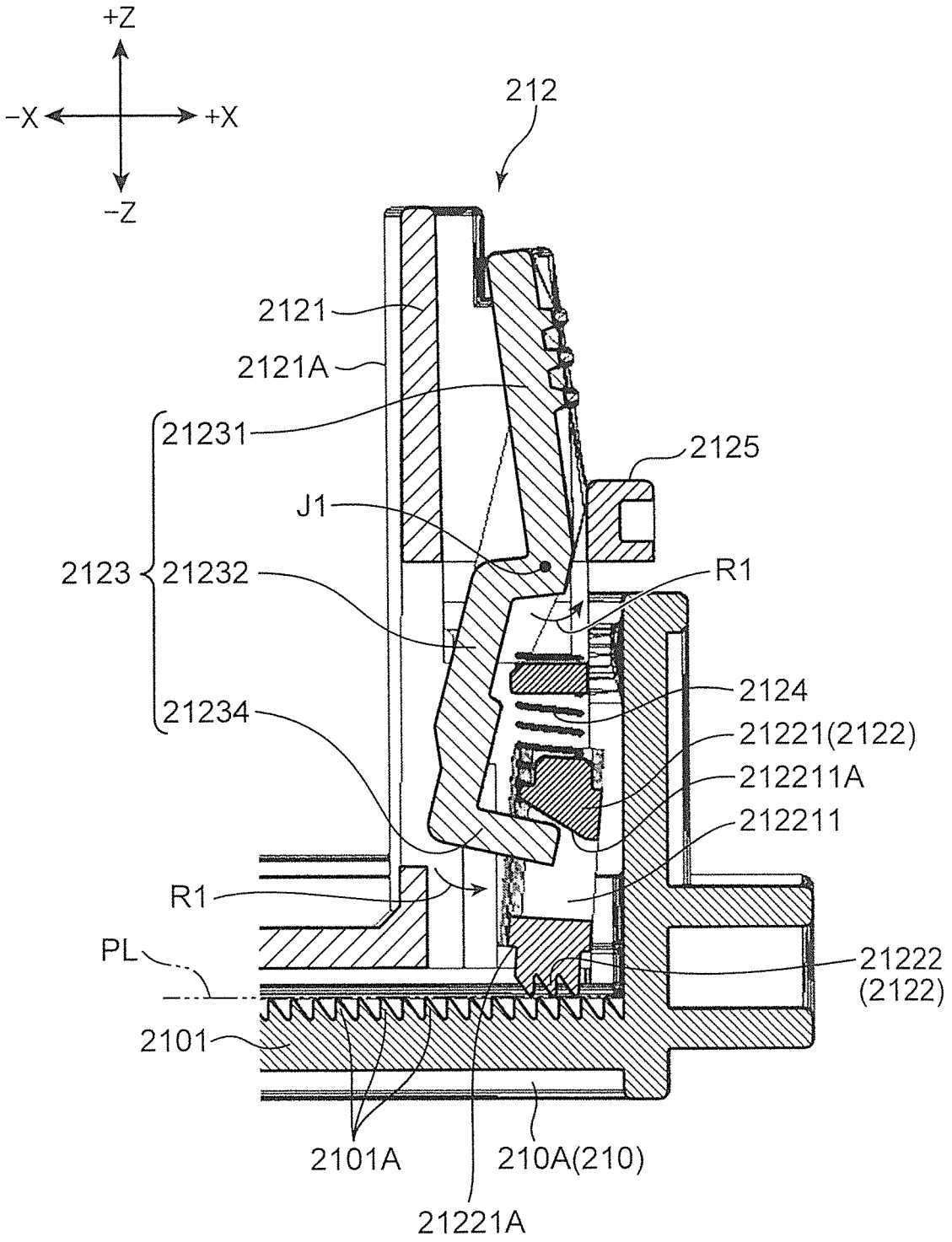
FIG. 7A illustrates the locking member moving from the unrestricting position to the restricting position in the first cursor, and is a sectional view of the first cursor taken along line A-A in FIG. 4.
Figure 7B:
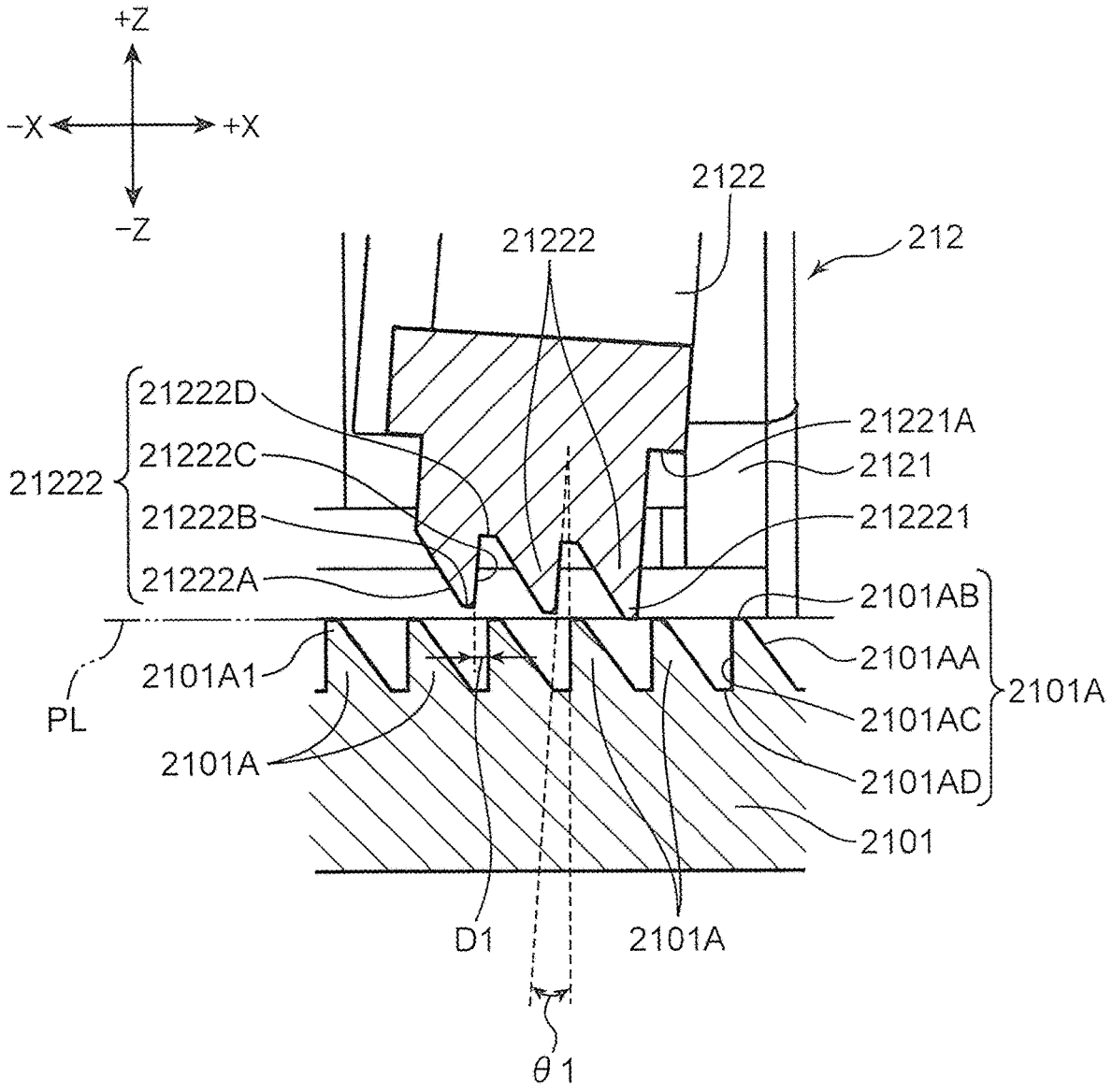
FIG. 7B is an enlarged sectional view illustrating an essential portion in FIG. 7A.
Figure 7C:
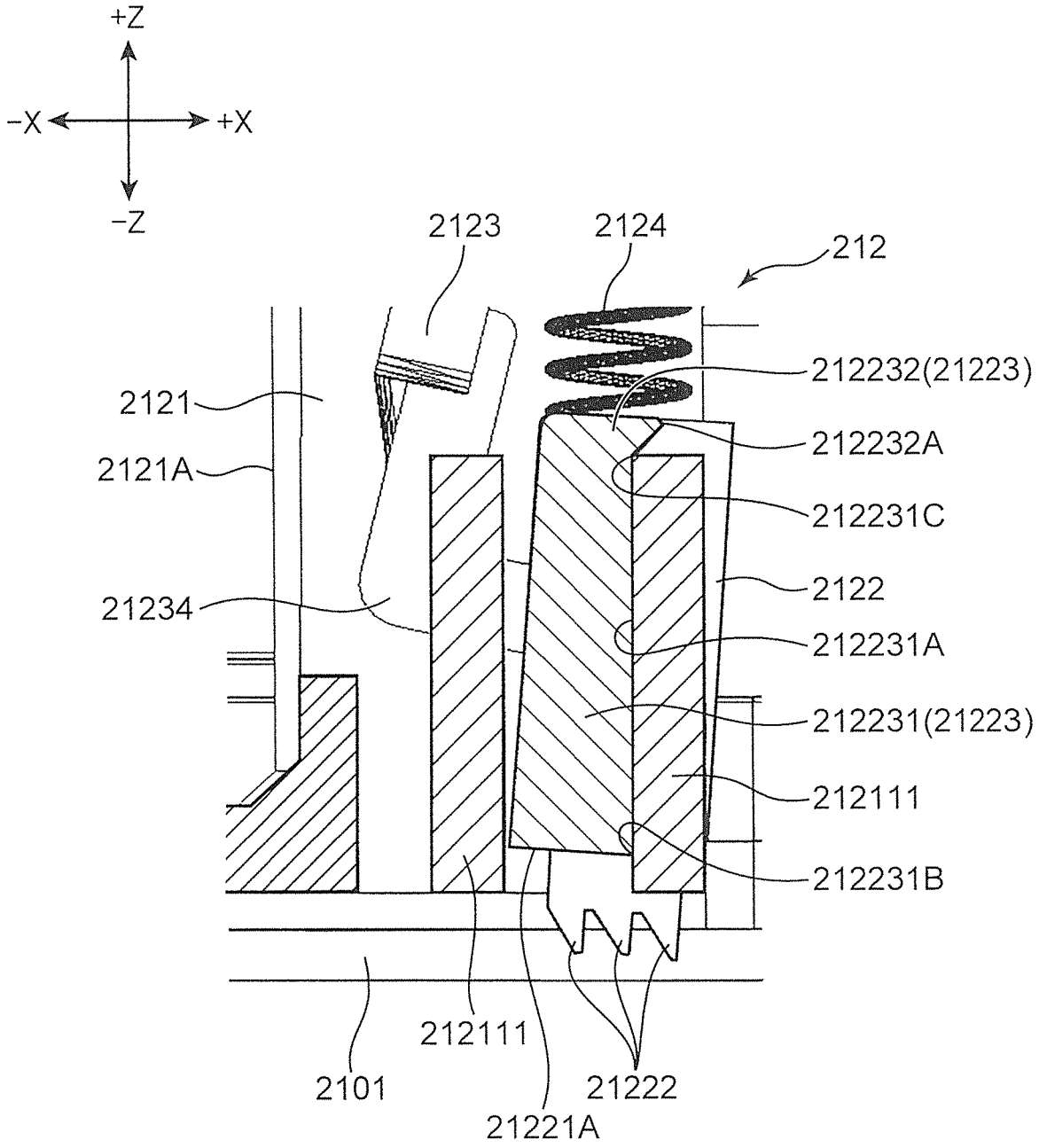
FIG. 7C illustrates the locking member moving from the unrestricting position to the restricting position in the first cursor, and is a sectional view of the first cursor taken along line B-B in FIG. 4.
Figure 8A:
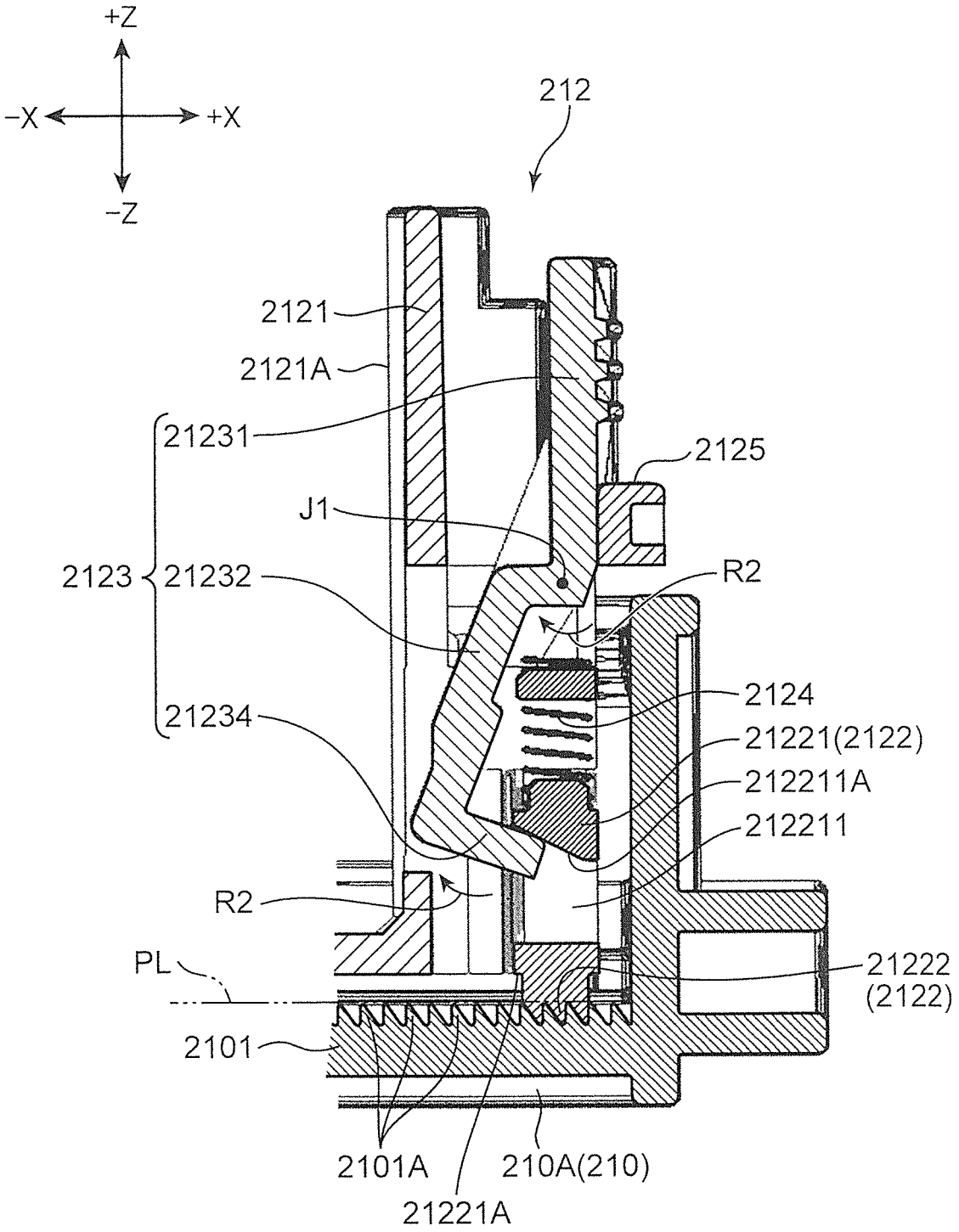
FIG. 8A illustrates the locking member taking an upright-posture at the restricting position in the first cursor, and is a sectional view of the first cursor taken along line A-A in FIG. 4.
Figure 8B:
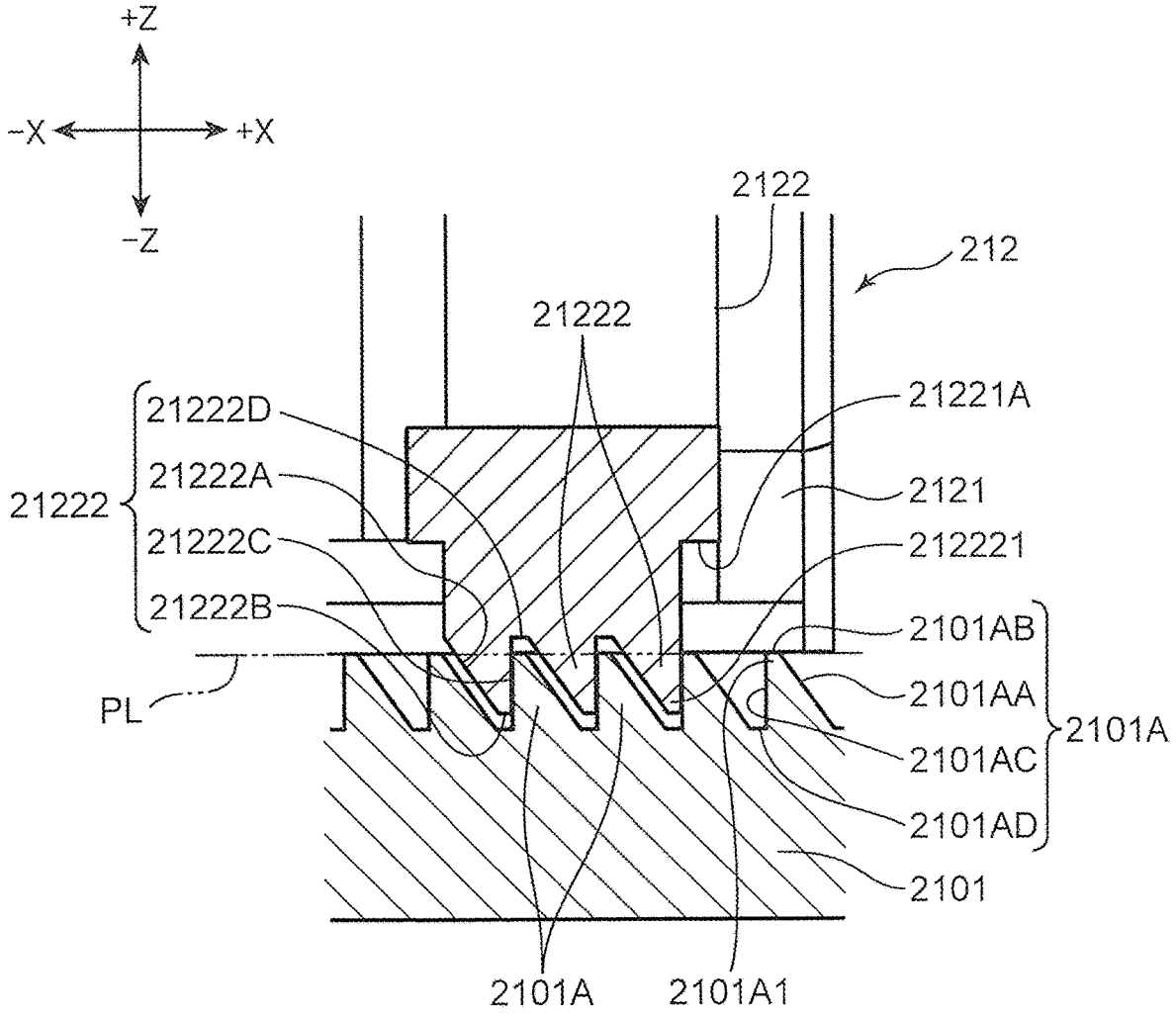
FIG. 8B is an enlarged sectional view illustrating an essential portion in FIG. 8A.
Figure 8C:
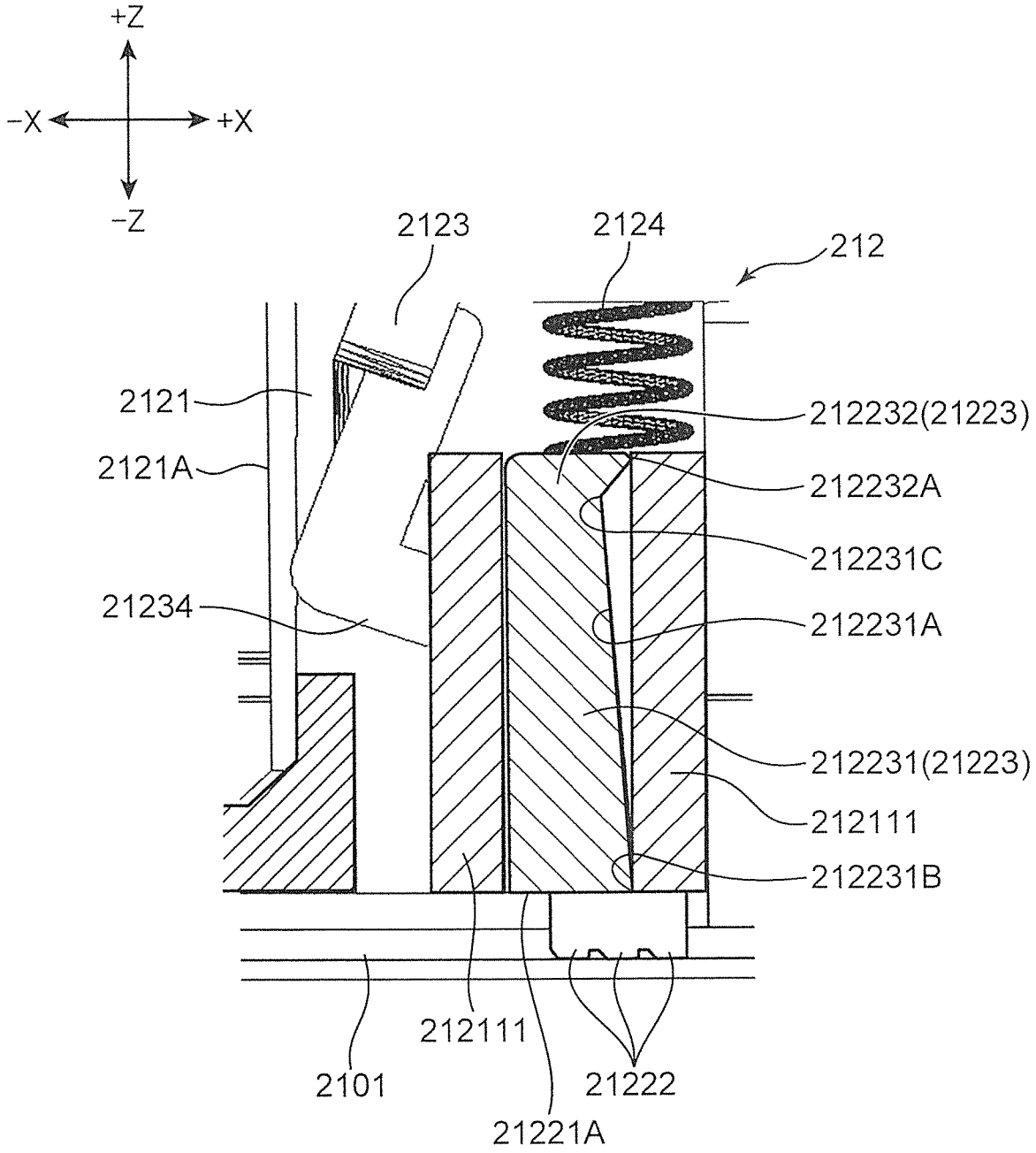
FIG. 8C illustrates the locking member taking the upright-posture at the restricting position in the first cursor, and is a sectional view of the first cursor taken along line B-B in FIG. 4.

Details on the first cursor 212 of the sheet feeding cassette 21 will now be described. FIG. 4 is a perspective view of the first cursor 212 of the sheet feeding cassette 21. FIG. 5 is a perspective view of a locking member 2122 of the first cursor 212. FIG. 6 is an enlarged perspective view illustrating an essential portion of the cursor body 2121 of the first cursor 212. FIGS. 7A to 7C illustrate the locking member 2122 moving from the unrestricting position to the restricting position in the first cursor 212. FIG. 7A is a sectional view of the first cursor 212 taken along line A-A in FIG. 4. FIG. 7B is an enlarged sectional view illustrating an essential portion in FIG. 7A. FIG. 7C is a sectional view of the first cursor 212 taken along line B-B in FIG. 4. FIGS. 8A to 8C illustrate the locking member 2122 taking the upright-posture at the restricting position in the first cursor 212. FIG. 8A is a sectional view of the first cursor 212 taken along line A-A in FIG. 4. FIG. 8B is an enlarged sectional view illustrating an essential portion in FIG. 8A. FIG. 8C is a sectional view of the first cursor 212 taken along line B-B in FIG. 4.

As described above, the first cursor 212 of the sheet feeding cassette 21 is movable in the X-direction (right-and-left direction) along the stopper rack 2101 in the cassette body 210. Hereinafter, X-direction in which the first cursor 212 moves along the stopper rack 2101 will be referred to as "moving direction X". In the moving direction X of the first cursor 212, the −X-directional side that is viewed when looking the middle portion (inner side) from the +X end of the cassette body 210 is referred to as "first side of the moving direction X", and the +X-directional side that is viewed when looking the end (outer side) from the middle portion (inner side) is referred to as "second side of the moving direction X".

The first cursor 212 includes a base 2120, a cursor body 2121, a locking member 2122, and a handling member 2123.

The cursor body 2121 includes a sheet-contact face 2121A that comes in contact with the +X side edge of the sheet S in the cassette body 210 and constitutes the main part of the first cursor 212. The cursor body 2121 has an approximately rectangular shape in a plan view in X-direction.

The cursor body 2121 includes a housing section 21211 (see FIGS. 4 and 6). The housing section 21211 is provided in the side face that faces the outer side (+X side) and is provided in the opposite side of the sheet-contact face 2121A of the cursor body 2121. The housing section 21211 is formed by cutting out a portion in the upper side (+Z side) of the bottom end 2121B of the side face. In the embodiment, the housing section 21211 is formed by cutting into the middle portion, with respect to Y-direction, from the bottom end 2121B of the cursor body 2121. In the space demarcated by the housing section 21211 in the cursor body 2121, a locking member 2122 which will be described later is disposed.

The base 2120 is a plate-like portion horizontally protruding in −X side from the bottom end of the cursor body 2121. The first positioning rack 215 described above extends in −X side from the base 2120.

The locking member 2122 is for restricting the movement of the first cursor 212 in the moving direction X along the stopper rack 2101. As illustrated in FIG. 4, the locking member 2122 is disposed in the housing section 21211 of the cursor body 2121. As illustrated in FIG. 5, the locking member 2122 includes the locking body 21221.

The locking body 21221 has an approximately rectangular shape and constitutes the main part of the locking member 2122. Locking teeth 21222 are provided on the bottom face 21221A of the locking body 21221. The locking teeth 21222 project downward (in −Z side) from the bottom face 21221A of the locking body 21221 and can mesh with the rack teeth 2101A of the stopper rack 2101. The locking teeth 21222 have a saw tooth shape in a sectional view normal to Y-direction. As illustrated in FIGS. 7B and 8B, the locking teeth 21222 are provided at a predetermined interval along the moving direction X of the first cursor 212. Each of the locking teeth 21222 includes a sloped face 21222A, a distal flat face 21222B, a vertical flat face 21222C, and a tooth root flat face 21222D.

The sloped face 21222A is inclined to the outer side (the second side of the moving direction X of the first cursor 212, namely, +X side) from the tooth root to the distal flat face 21222B (downward). The distal flat face 21222B slightly extends in the outer side from the bottom end of the sloped face 21222A to form the tooth tip 212221 of each of the locking teeth 21222. The vertical flat face 21222C is further in the outer side than the sloped face 21222A and vertically extends from the tooth root to the distal flat face 21222B. The tooth root flat face 21222D slightly extends in the outer side from the vertical flat face 21222C to form the tooth root of each of the locking teeth 21222.

As illustrated in FIGS. 7B and 8B, the rack teeth 2101A of the stopper rack 2101 that mesh with the locking teeth 21222 have a saw shape, and each of the rack teeth 2101A has a sloped face 2101AA, a distal flat face 2101AB, a rising flat face 2101AC, and a tooth root flat face 2101AD.

The sloped face 2101AA is inclined to the inner side (the first side of the moving direction X of the first cursor 212, namely, −X side) from the tooth root to the distal flat face 2101AB (upward). The distal flat face 2101AB slightly extends in the inner side from the bottom end of the sloped face 2101AA to form the tooth tip 2101A1 of each of the rack teeth 2101A. The rising flat face 2101AC is further in the inner side than the sloped face 2101AA and linearly extends upward from the tooth root to the distal flat face 2101AB. The tooth root flat face 2101AD slightly extends in the inner side from the rising flat face 2101AC to form the tooth root of the rack teeth 2101A.

In the embodiment, the locking member 2122 of the first cursor 212 can move in the vertical direction (Z-direction), relative to the cursor body 2121, between the restricting position where the locking teeth 21222 mesh with the rack teeth 2101A to restrict the movement of the first cursor 212 and the unrestricting position where the locking teeth 21222 are positioned above and separated from the rack teeth 2101A to allow the movement of the first cursor 212. FIGS. 8A to 8C illustrate the states in which the locking member 2122 is positioned at the restricting position. FIGS. 7A to 7C illustrate the states in which the locking member 2122 is positioned at the unrestricting position.

The handling member 2123 of the first cursor 212 is supported on the cursor body 2121 and is used to move the locking member 2122. A user uses the handling member 2123 to move the locking member 2122. The locking member 2122 moves from the unrestricting position to the restricting position as well as from the restricting position to the unrestricting position by user's operation of the handling member 2123.

As the locking member 2122 is moved between the restricting position and the unrestricting position by using the handling member 2123, the locking member 2122 takes the tilt-posture as illustrated in FIGS. 7A to 7C. When the locking member 2122 takes the tilt-posture, the bottom face 21221A of the locking body 21221 is inclined with respect to an imaginary plane PL including the distal flat faces 2101AB of the rack teeth 2101A, and the locking teeth 21222 are inclined with respect to the vertical direction and displaced along the moving direction X of the first cursor 212.

In more detail, when the locking member 2122 takes the tilt-posture, the locking teeth 21222 are inclined so as the tooth tip 212221 to be closer to the sheet S stored in the cassette body 210. In other words, when the locking member 2122 takes the tilt-posture, the locking teeth 21222 is inclined with the tooth tip 212221 directed toward the inner side (−X side). In other words, when the locking member 2122 takes the tilt-posture, the locking teeth 21222 are inclined so as the vertical flat face 21222C to incline to the inner side from the top end to the bottom end, or to incline with respect to the rising flat face 2101AC of the rack teeth 2101A.

The angle θ1 of the vertical flat face 21222C of the locking teeth 21222 to the rising flat face 2101AC of the rack teeth 2101A (see FIG. 7B) is set within such a range that each tooth tip 212221 of the locking teeth 21222 is positioned between the adjacent rack teeth 2101A when viewed along Z-direction. That is, the locking member 2122 takes the tilt-posture such that each tooth tip 212221 of the locking teeth 21222 comes between the adjacent rack teeth 2101A when viewed along Z-direction.

When the locking member 2122 is in the tilt-posture when moving between the restricting position and the unrestricting position, the locking teeth 21222 are inclined with respect to the vertical direction and displaced along the moving direction X of the first cursor 212. This inclination may readily provide a clearance D1 along the moving direction X of the first cursor 212 between the tooth tips 212221 of the locking teeth 21222 and the tooth tips 2101A1 of the rack teeth 2101A (see FIG. 7B). The clearance D1 created by the locking member 2122 taking the tilt-posture is expressed by the distance along the moving direction X from the bottom end of the vertical flat face 21222C of the locking teeth 21222 (the intersection point of the vertical flat face 21222C and the distal flat face 21222B) to the rising flat face 2101AC of the rack teeth 2101A.

The clearance D1 readily provided by the locking member 2122 taking the tilt-posture prevents the tooth tips 212221 of the locking teeth 21222 of the locking member 2122 from abutting the tooth tips 2101A1 of the rack teeth 2101A of the stopper rack 2101 when the locking member 2122 moves from the unrestricting position to the restricting position. As a result, misalignment of the engaging position between the locking teeth 21222 and the rack teeth 2101A that may occur when moving the locking member 2122 from the unrestricting position to the restricting position can effectively be prevented. The sheet S can thus be positioned in the cassette body 210 by the first cursor 212 with high accuracy. With such a configuration, the sheet feeding cassette 21 with excellent property of feeding the sheet S can be provided.

Depending on the position of the first cursor 212, the clearance D1 may be 0 (zero). Also, in such a case, the locking teeth 21222 are inclined and the tooth tips 212221 are directed to the inner side (−X side) (so as the tooth tips 212221 to be positioned closer to the sheet S) when the locking member 2122 takes the tilt-posture. The locking teeth 21222 are thereby guided to the inner side (−X side) as the locking member 2122 moves from the unrestricting position to the restricting position. With the locking member 2122 positioned at the restricting position, for example, the locking teeth 21222 engage with the rack teeth 2101A at a position closer to the sheet S than when the locking teeth 21222 are inclined so as the tooth tips 212221 to be directed to the outer side (+X side) away from the sheet S. Accordingly, the locking member 2122 is positioned at the restricting position with the first cursor 212 positioned further closer to the sheet S, and thus the sheet S can further accurately be positioned by the first cursor 212.

The locking member 2122 is configured to take an upright-posture at the restricting position as illustrated in FIGS. 8A to 8C. When the locking member 2122 takes the upright-posture, the bottom face 21221A of the locking body 21221 (or the plane on which the tooth tips 212221 of the locking teeth 21222 are disposed) is parallel to the imaginary plane PL including the distal flat faces 2101AB of the rack teeth 2101A and the locking teeth 21222 are positioned upright along the vertical direction (Z-direction) and normal to the imaginary plane PL. In more detail, when the locking member 2122 is in the upright-posture, the locking teeth 21222 are positioned upright with the vertical flat faces 21222C parallel to the rising flat faces 2101AC of the rack teeth 2101A.

The locking member 2122 takes the tilt-posture when moving between the restricting position and the unrestricting position, and takes the upright-posture when positioned at the restricting position. As described above, when the locking member 2122 takes the tilt-posture, the clearance D1 along the moving direction X of the first cursor 212 is readily created between the tooth tips 212221 of the locking teeth 21222 and the tooth tips 2101A1 of the rack teeth 2101A.

When the locking member 2122 takes the upright-posture at the restricting position, the clearance D1 between the tooth tips 212221 and the tooth tips 2101A1 along the moving direction X of the first cursor 212 is 0 (zero). That is, when the locking member 2122 takes the upright-posture at the restricting position, the vertical flat faces 21222C of the locking teeth 21222 are in contact with the rising flat faces 2101AC of the rack teeth 2101A. With the locking member 2122 taking the upright-posture at the restricting position, the locking teeth 21222 surely mesh with the rack teeth 2101A. Accordingly, the locking member 2122 positioned at the restricting position surely restricts the movement of the first cursor 212, and thereby the sheet S is positioned in the cassette body 210 by the first cursor 212 with high accuracy.

In the embodiment, the first cursor 212 further includes an urging member 2124 and an anti-pivot plate 2125 as illustrated in FIG. 4. As illustrated in FIG. 5, the locking member 2122 of the first cursor 212 further includes a guided-projection 21223 and a support boss 21224. As illustrated in FIG. 6, the housing section 21211 of the cursor body 2121 of the first cursor 212 includes a pair of the guiding pieces 212111.

The locking member 2122 has the guided-projections 21223 provided on two side faces 21221C, facing the sheet feeding direction H2 (Y-direction), of the locking body 21221. In FIG. 5, the guided-projection 21223 protruding from the side face 21221C of the locking body 21221 in the +Y side is illustrated, but the guided-projection 21223 protruding from the side face 21221C of the locking body 21221 in the −Y side is not illustrated.

The guided-projection 21223 has an approximately rectangular shape extending in Z-direction and has a sloped section 212231 and a protruding section 212232. The sloped section 212231 has a sloped face 212231A that is inclined, from the bottom end 212231B to the top end 212231C, to the first side of the moving direction X (−X side) of the first cursor 212. An opposite face 212233 that is further in the first side of the moving direction X than the sloped face 212231A is a vertical face extending in Z-direction.

The protruding section 212232 protrudes in the second side (+X side) of the moving direction X of the first cursor 212, continuing from the top end 212231C of the sloped face 212231A. In the moving direction X of the first cursor 212, the protruding end 212232A of the protruding section 212232 and the bottom end 212231B of the sloped face 212231A are at the identical location.

A pair of the guiding pieces 212111 of the housing section 21211 of the cursor body 2121 is provided on each of the inner faces 21211A that face each other along Y-direction in the housing section 21211. A pair of the guiding pieces 212111 extends in the vertical direction (Z-direction) so as to oppose the guided-projections 21223 provided on each side face 21221C of the locking body 21221 of the locking member 2122. In other words, the guided-projection 21223 comes between a pair of the guiding pieces 212111. A pair of the guiding pieces 212111 guides the locking member 2122 to move in the vertical direction with the guided-projection 21223 disposed between guiding pieces 212111.

When the locking member 2122 moves from the unrestricting position to the restricting position or from the restricting position to the unrestricting position with the guided-projection 21223 disposed between a pair of the guiding pieces 212111, the protruding end 212232A of the protruding section 212232 advances over the top end of the guiding piece 212111 and the sloped face 212231A of the sloped section 212231 contacts the guiding piece 212111 that is in +X side, and thus the locking member 2122 takes the tilt-posture (see FIG. 7C). When the locking member 2122 is at the restricting position, the protruding end 212232A of the protruding section 212232 and the bottom end 212231B of the sloped face 212231A contact the guiding piece 212111 that is in +X side, and thus the locking member 2122 takes the upright-posture (see FIG. 8C).

The locking body 21221 of the locking member 2122 includes a recess 212211 as illustrated in FIG. 5. The recess 212211 is opened along the moving direction X of the first cursor 212. A top face 212211A that demarcates the inner top face of the recess 212211 is inclined downward from the first side (−X side) to the second side (+X side) of the moving direction X of the first cursor 212.

The support boss 21224 projects upward from the top face 21221B of the locking body 21221. An end of the urging member 2124 engages with the support boss 21224. For example, the urging member 2124 is made of a coil spring, and the end, opposite the end engaging with the support boss 21224, of the urging member 2124 engages with the cursor body 2121. The urging member 2124 urges the locking member 2122 downward.

With reference to FIGS. 6, 7A, and 8A, the handling member 2123 includes a handling section 21231, an extending section 21232, a supporting section 21233, and an engaging section 21234. The handling member 2123 is supported on the cursor body 2121 by the supporting section 21233 so as to pivot about an axis J1 extending in Y-direction that intersects both the moving direction X of the first cursor 212 and the vertical direction.

A user handles the handling section 21231. By a user pushing the handling section 21231 to −X side, the handling member 2123 pivots about the axis J1 in a first pivot direction R1 (see FIG. 7A). By pivoting of the handling member 2123 in the first pivot direction R1 made by a user pivoting the handling section 21231, the locking member 2122 shifts from the upright-posture to the tilt-posture and moves from the restricting position to the unrestricting position.

By a user cancelling the pivoting of the handling section 21231, the locking member 2122 shifts from the tilt-posture to the upright-posture and moves from the unrestricting position to the restricting position. Upon cancelling the pivoting of the handling section 21231, the locking member 2122 moves to pivot the handling member 2123 about the axis J1 in a second pivot direction R2 which is opposite the first pivot direction R1 (see FIG. 8A). Pivoting of the handling member 2123 in the second pivot direction R2 is stopped by the locking member 2122 being positioned at the restricting position with the locking teeth 21222 meshing with the rack teeth 2101A.

The anti-pivot plate 2125 restricts pivoting of the handling member 2123 while the first cursor 212 is removed from the cassette body 210.

The extending section 21232 of the handling member 2123 extends downward from the bottom end of the handling section 21231. The engaging section 21234 protrudes in +X side from the bottom end of the extending section 21232. The engaging section 21234 is inserted in the recess 212211 of the locking member 2122 from the first side (−X side) of the moving direction X of the first cursor 212 to contact the top face 212211A.

From the state where the locking member 2122 is positioned at the restricting position and taking the upright-posture, the distal end of the engaging section 21234 pushes the sloped face of the top face 212211A of the recess 212211 as the handling member 2123 pivots in the first pivot direction R1, and thereby the locking member 2122 rises, moving from the restricting position to the unrestricting position. As the locking member 2122 rises and the protruding end 212232A of the protruding section 212232 advances over the top end of the guiding piece 212111, the distal end of the engaging section 21234 slides with respect to the sloped face of the top face 212211A. This sliding creates a force component normal to the sloped face of the top face 212211A, and this force that acts diagonally upward causes the locking member 2122 to pivot to −X side and take the tilt-posture. The locking member 2122 moves, keeping the tilt-posture, diagonally upward to the unrestricting position while the guided-projection 21223 is guided by a pair of the guiding pieces 212111. In this manner, by the engaging section 21234 sliding with respect to the top face 212211A as the handling member 2123 pivots in the first pivot direction R1, the locking member 2122 moves, against the urging force of the urging member 2124, from the restricting position to the unrestricting position and shifts from the upright-posture to the tilt-posture.

By a user cancelling the pivoting of the handling section 21231 when the locking member 2122 is positioned at the unrestricting position and taking the tilt-posture, the urging force of the urging member 2124 moves the locking member 2122 diagonally downward from the unrestricting position to the restricting position. Upon cancelling the pivoting of the handling section 21231, the locking member 2122 moves to pivot the handling member 2123 to the second pivot direction R2.

As described above, the sheet feeding cassette 21 according to the embodiment is such that the locking member 2122 takes the tilt-posture when moving in the vertical direction between the restricting position and the unrestricting position. When the locking member 2122 is taking the tilt-posture, the locking teeth 21222 are inclined with respect to the vertical direction and displaced along the moving direction X of the first cursor 212. Thus, abutting of the tooth tips 212221 of the locking teeth 21222 of the locking member 2122 against the tooth tips 2101A1 of the rack teeth 2101A of the stopper rack 2101 when the locking member 2122 is moving from the unrestricting position to the restricting position is easily avoided. As a result, the sheet S is positioned in the cassette body 210 by the first cursor 212 with high accuracy. Accordingly, the sheet feeding cassette 21 is provided with excellent property of feeding the sheet S.

Furthermore, in a case when the tooth tips 212221 of the locking teeth 21222 abut the tooth tips 2101A1 of the rack teeth 2101A when the locking member 2122 is moving from the unrestricting position to the restricting position, the locking teeth 21222 are guided to the inner side (−X side) as the locking member 2122 moves, since the locking teeth 21222 is inclined to direct the tooth tips 212221 to the inner side (−X side) (so as to be closer to the sheet S). Accordingly, with the locking member 2122 positioned at the restricting position, the sheet S is surely positioned by the first cursor 212.

The image forming apparatus 1 according to the embodiment includes the sheet feeding cassette 21 having excellent property of feeding the sheet S, and thus can prevent deterioration in efficiency of image forming processing performed by the image forming unit 30 due to misfeeding of the sheet S.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. A sheet feeding cassette comprising:

a cassette body that stores a sheet to be fed in a predetermined sheet feeding direction;

a cursor that is provided in a manner movable in a moving direction intersecting the sheet feeding direction and positions the sheet in the cassette body; and a rack that is disposed along the moving direction on a bottom face of the cassette body and includes a plurality of rack teeth provided at a predetermined interval to project upward, wherein the cursor includes a cursor body having opposite first and second sides, a sheet-contact face disposed at the first side and comes in contact with an edge of the sheet and a housing section provided at the second side of the cursor body and opposite to the sheet contact face in the moving direction of the cursor, and a locking member that is disposed in a space demarcated by the housing section in the cursor body to lock movement of the cursor, the locking member includes a locking body having, on a bottom face, locking teeth projecting downward, the locking teeth meshing with the rack teeth located below the housing section, the locking member being movable inside the housing section in a vertical direction between a restricting position where the locking teeth mesh with the rack teeth to restrict movement of the cursor and an unrestricting position where the locking teeth are positioned above and separated from the rack teeth to allow movement of the cursor, and the locking member takes a tilt-posture when moving between the restricting position and the unrestricting position, the tilt-posture being such that the bottom face of the locking body inclines with respect to an imaginary plane including distal tips of the rack teeth and the locking teeth incline with respect to the vertical direction to be displaced along the moving direction of the cursor, wherein:

the locking teeth incline so as tooth tips to be directed toward the sheet when the locking member takes the tilt-posture, the locking member positioned at the restricting position takes an upright-posture in which a plane on which the tooth tips of the locking teeth are disposed is parallel to the imaginary plane, the locking member further includes a guided-projection projecting from a side face of the locking body to extend in the vertical direction, the guided-projection having a sloped face that is inclined to a first side of the moving direction of the cursor from a bottom end to a top end, and a protruding section that protrudes in a second side of the moving direction of the cursor from the top end of the sloping face, a protruding end of the protruding section and the bottom end of the sloped face being at an identical location in the moving direction of the cursor, the housing section of the cursor body includes a guiding piece that extends in the vertical direction so as to oppose the sloped face and the protruding section of the guided-projection to guide the locking member to move, the locking member takes the tilt-posture when the protruding section advances over a top end of the guiding piece and the sloped face is in contact with the guiding piece, and the locking member takes the upright-posture with the protruding end of the protruding section and the bottom end of the sloped face in contact with the guiding piece.

2. The sheet feeding cassette according to claim 1, wherein the cursor includes a handling member that is supported on the cursor body and used for moving the locking member, and the locking member takes the tilt-posture when moving between the restricting position and the unrestricting position by handling of the handling member.

3. The sheet feeding cassette according to claim 1, wherein the cursor includes a handling member supported on the cursor body to pivot about an axis extending in the sheet feeding direction, and the locking member moves from the restricting position to the unrestricting position by handling of the handling member.

4. The sheet feeding cassette according to claim 3, wherein the cursor further includes an urging member that urges the locking member downward, the locking body has a recess that has an opening opened along the moving direction of the cursor and a top face that is inclined downward from the first side to the second side of the moving direction of the cursor, the handling member includes an engaging section that is inserted in the recess from the opening in the first side of the moving direction of the cursor to contact the top face, and by the engaging section sliding along the top face by the pivoting of the handling member, the locking member moves from the restricting position to the unrestricting position and shifts from the upright-posture to the tilt-posture against an urging force of the urging member, and upon cancelling the handling of the handling member, the locking member moves from the unrestricting position to the restricting position and shifts from the tilt-posture to the upright-posture by the urging force of the urging member.

5. An image forming apparatus comprising:

the sheet feeding cassette according to claim 1;

a main housing in which the sheet feeding cassette is detachably set; and an image forming unit that is disposed in the main housing and forms an image on a sheet fed from the sheet feeding cassette.

* * * * *